US011208752B2

(12) United States Patent
Kim et al.

(10) Patent No.: US 11,208,752 B2
(45) Date of Patent: Dec. 28, 2021

(54) LAUNDRY PROCESSING APPARATUS

(71) Applicant: LG Electronics Inc., Seoul (KR)

(72) Inventors: Keunjoo Kim, Seoul (KR); Jaeyong Jeong, Seoul (KR); Oshin Kwon, Seoul (KR); Dongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 742 days.

(21) Appl. No.: 16/070,646

(22) PCT Filed: Jan. 3, 2017

(86) PCT No.: PCT/KR2017/000045
§ 371 (c)(1),
(2) Date: Jul. 17, 2018

(87) PCT Pub. No.: WO2017/126824
PCT Pub. Date: Jul. 27, 2017

(65) Prior Publication Data

US 2021/0207310 A1 Jul. 8, 2021

(30) Foreign Application Priority Data

Jan. 21, 2016 (KR) ..... 10-2016-0007687

(51) Int. Cl.
*D06F 37/40* (2006.01)
*D06F 17/08* (2006.01)
(Continued)

(52) U.S. Cl.
CPC ..... *D06F 37/40* (2013.01); *D06F 17/08* (2013.01); *D06F 23/04* (2013.01); *D06F 31/00* (2013.01)

(58) Field of Classification Search
CPC ..... D06F 37/40
See application file for complete search history.

(56) References Cited

U.S. PATENT DOCUMENTS 5,033,278 A 7/1991 Hossfield et al.
2010/0307200 A1* 12/2010 Jeong ..... D06F 31/00 68/13 R
2012/0304704 A1 12/2012 Ponnaganti et al.

FOREIGN PATENT DOCUMENTS

DE 102008027977 1/2009
JP 2000-042286 2/2000
(Continued)

OTHER PUBLICATIONS

Extended European Search Report in European Application No. 17741590.8, dated Jul. 24, 2019, 9 pages.

*Primary Examiner* — Jason Y Ko
(74) *Attorney, Agent, or Firm* — Fish & Richardson P.C.

(57) ABSTRACT

The present invention relates to a laundry processing apparatus comprising: a tub for storing water and having an opening for putting in and taking out laundry; a drum, provided in the interior of the tub, for storing the laundry supplied through the opening; an agitator rotatably provided inside the drum; a fixed body fixed to the drum; a drum fixing part having a body-penetrating hole provided so as to penetrate the fixed body, and an accommodating body which is fixed to the fixed body and the cross-sectional surface of which is concentric with the body-penetrating hole; a rotating shaft connected to the agitator by penetrating the tub and drum, and inserted into the body-penetrating hole; a drive gear positioned inside the accommodating body and fixed to the rotating shaft; a driven gear provided along the inner circumferential surface of the accommodating body; at least two connecting gears connecting the drive gear and driven gear; a housing to which each connecting gear is rotatably fixed and which rotates inside the accommodating body due to the connecting gears; and a housing stopper, provided on at least one from among the housing and fixed body, for
(Continued)

stopping the rotation of the housing when the rotating shaft has rotated by a previously set number of times.

20 Claims, 4 Drawing Sheets

(51) Int. Cl.
*D06F 23/04* (2006.01)
*D06F 31/00* (2006.01)

(56) References Cited

FOREIGN PATENT DOCUMENTS

| | | |
|---|---|---|
| KR | 10-2008-0065765 | 7/2008 |
| KR | 10-2011-0043906 | 4/2011 |
| KR | 10-2015-0008347 | 1/2015 |
| KR | 10-2015-0075833 | 7/2015 |

* cited by examiner

【FIG. 1】
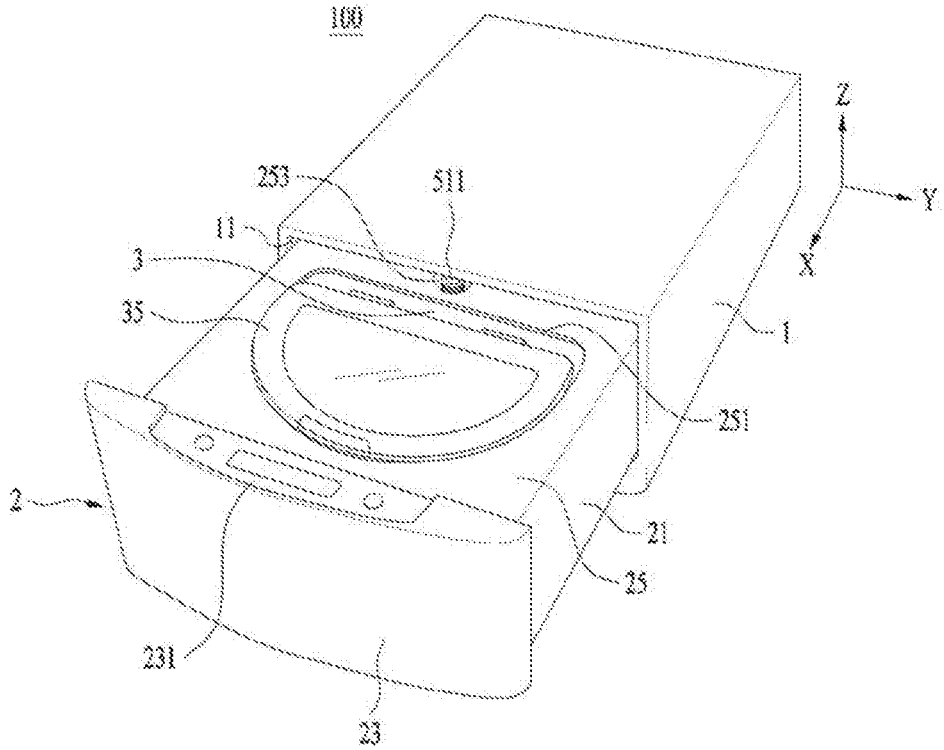
【FIG. 2】
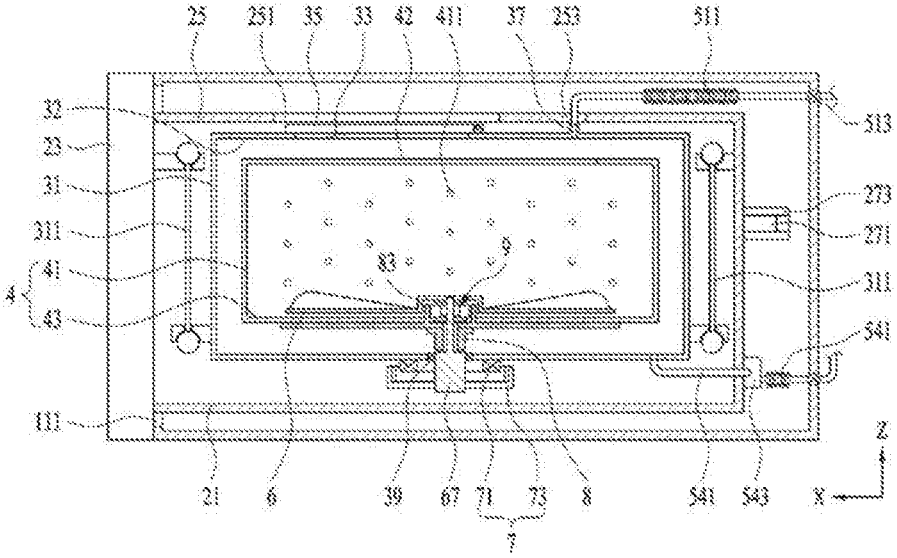

【FIG. 3】
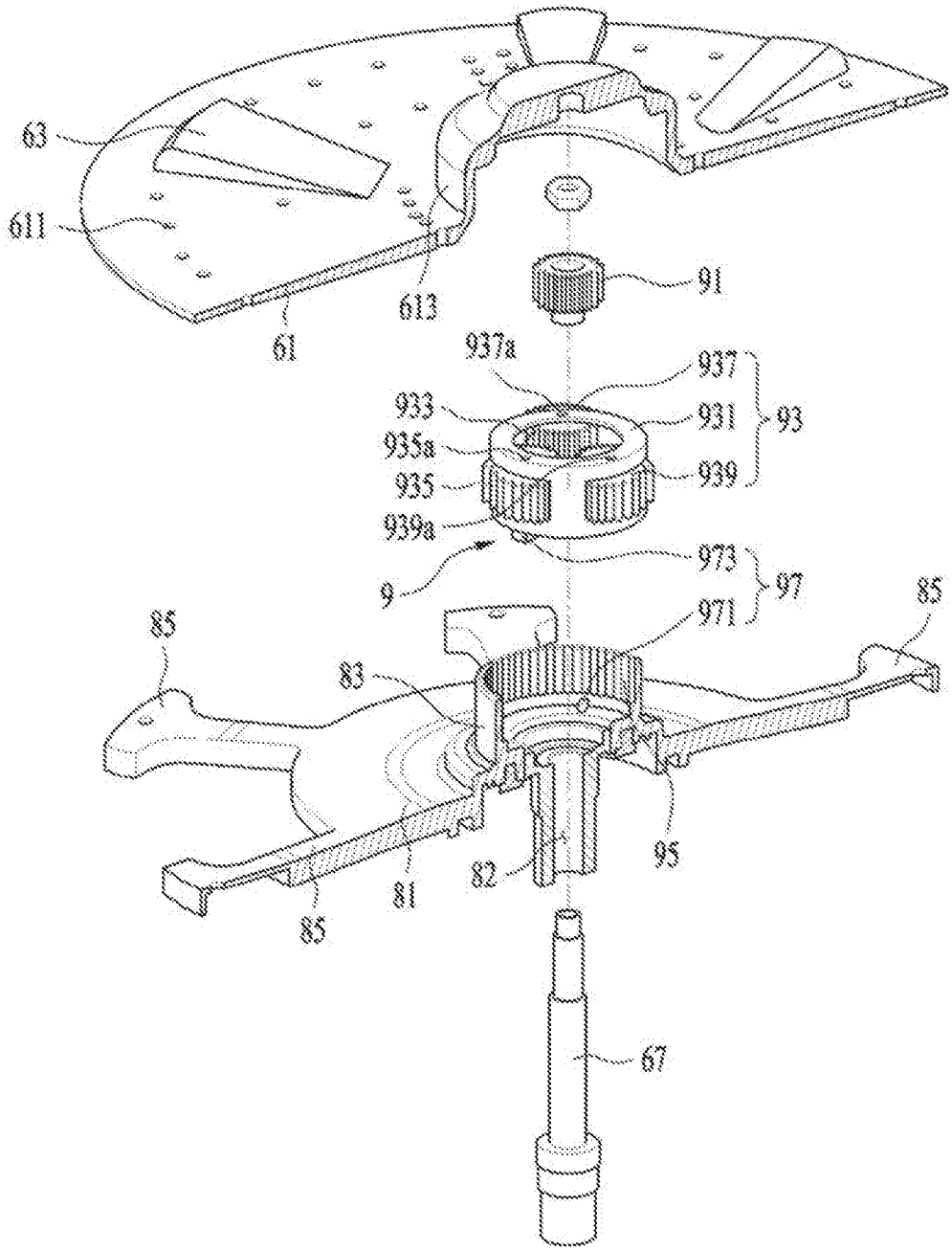

【FIG. 4】
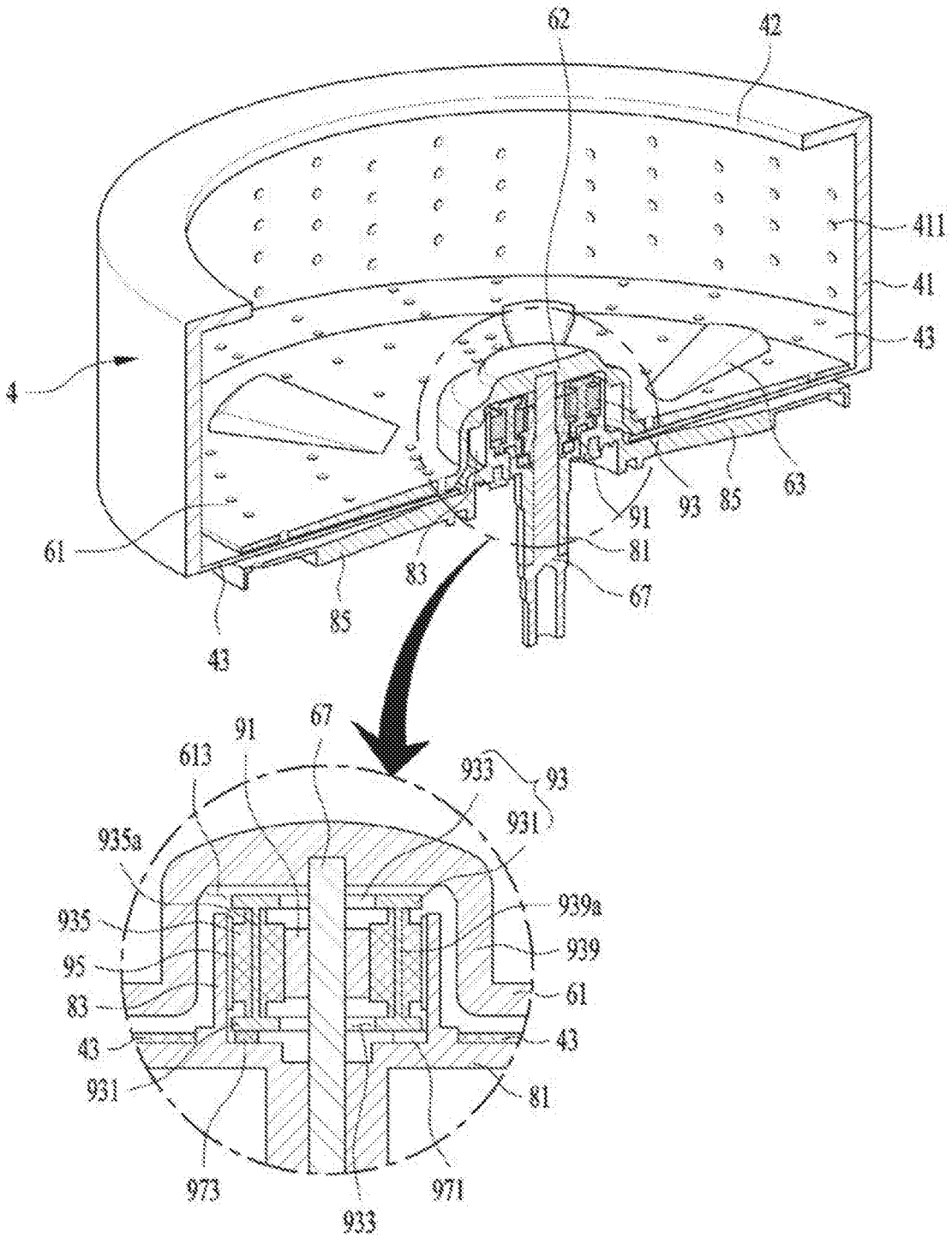

【FIG. 5】
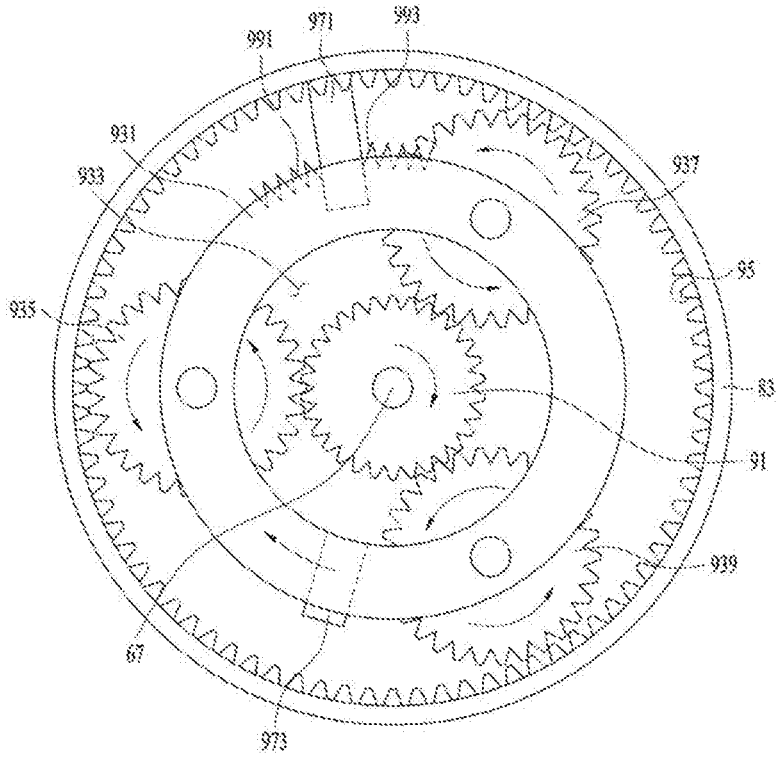
【FIG. 6】
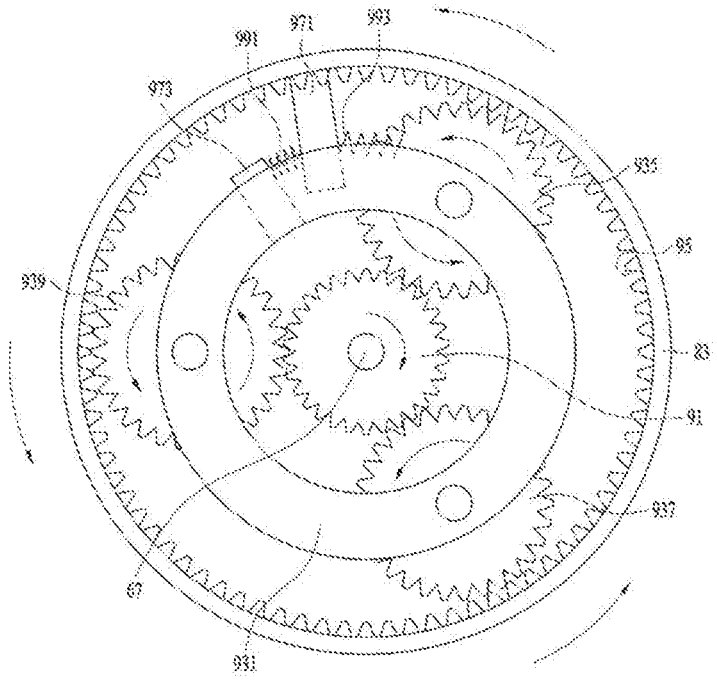

LAUNDRY PROCESSING APPARATUS

CROSS-REFERENCE TO RELATED APPLICATIONS

This application is a National Stage application under 35 U.S.C. § 371 of International Application No. PCT/KR2017/000045, filed on Jan. 3, 2017, which claims the benefit of Korean Application No. 10-2016-0007687, filed on Jan. 21, 2016. The disclosures of the prior applications are incorporated by reference in their entirety.

TECHNICAL FIELD

The present invention relates to a laundry treatment apparatus.

BACKGROUND ART

Generally, laundry treatment apparatuses include an apparatus that washes laundry (a washing object or a drying object), an apparatus that dries laundry, and an apparatus that is capable of performing both washing and drying of laundry.

Among conventional laundry treatment apparatuses, there is an example including a cabinet, a drawer configured to be introduced into or removed from the cabinet, and an accommodation unit provided inside the drawer to provide a laundry accommodation portion (a laundry treatment space) for washing or drying laundry.

The laundry treatment apparatus, in which the laundry accommodation unit is provided in the drawer, which may be introduced into or removed from the cabinet, may store therein a greater amount of water and laundry when the volume of the laundry accommodation unit is greater, and thus may achieve improved washing ability.

Therefore, in the conventional laundry treatment apparatus including the laundry accommodation unit inside the drawer, minimizing the volume of the laundry accommodation unit while increasing washing ability is a very important design objective.

DISCLOSURE

Technical Problem

One object of the present invention devised to solve the problem lies in a laundry treatment apparatus capable of minimizing the volume thereof while increasing the washing ability thereof.

In addition, another object of the present invention devised to solve the problem lies in a laundry treatment apparatus in which a drum, in which laundry is stored, and an agitator, which is rotatably provided inside the drum, are rotated by a single drive unit.

In addition, a further object of the present invention devised to solve the problem lies in a laundry treatment apparatus in which an agitator is rotated a predetermined number of times inside a drum, and thereafter, the agitator and the drum are rotated in opposite directions.

Technical Solution

The object of the present invention can be achieved by providing a laundry treatment apparatus including a tub configured to store water therein and including a tub introduction opening for introduction or removal of laundry, a drum provided inside the tub to store the laundry supplied through the tub introduction opening, an agitator rotatably provided inside the drum, a drum fixing unit including a fixing body fixed to the drum, a body through-hole formed in the fixing body, and an accommodation body fixed to the fixing body such that a cross section thereof forms a concentric circle with the body through-hole, a rotating shaft penetrating the tub and the drum to thereby be connected to the agitator, the rotating shaft being inserted into the body through-hole, a driving gear located inside the accommodation body and fixed to the rotating shaft, a driven gear provided along an inner circumferential surface of the accommodation body, at least two connection gears configured to interconnect the driving gear and the driven gear, a housing, to which the respective connection gears are rotatably fixed such that the housing is rotated inside the accommodation body by the connection gears, and a housing stopper provided on at least one of the housing or the fixing body to stop rotation of the housing when the rotating shaft is rotated a predetermined number of times.

The housing stopper may be provided at a position at which it stops rotation of the housing when the rotating shaft completes one or more rotations.

The housing stopper may include a first stopper provided inside the accommodation body, and a second stopper provided on the housing so as to come into contact with the first stopper when the housing is rotated by a predetermined reference angle.

The driving gear, the driven gear, and the connection gears may have a gear ratio that brings the first stopper into contact with the second stopper when the rotating shaft completes one or more rotations.

The reference angle may be set to an angle that is equal to or greater than 270 degrees and is less than 360 degrees.

The laundry treatment apparatus may further include an elastic body provided on the first stopper to push the second stopper far away from the first stopper when the second stopper is coupled to the first stopper.

The elastic body may include at least one of a first spring configured to push the second stopper in a counterclockwise direction when the housing is rotated in a clockwise direction so that the second stopper comes into contact with the first stopper or a second spring configured to push the second stopper in the clockwise direction when the housing is rotated in the counterclockwise direction so that the second stopper comes into contact with the first stopper The connection gears may be spaced apart from each other by the same angle about the rotating shaft.

The laundry treatment apparatus may further include a cabinet including an opening, and a drawer, to which the tub is fixed, the drawer being introduced into or removed from the cabinet through the opening.

The rotating shaft may penetrate a bottom surface of the tub and a bottom surface of the drum and is fixed to the agitator.

The rotating shaft may be provided so as to form a right angle relative to a ground, on which the cabinet is seated.

A drive unit may include a stator fixed to the bottom surface of the tub so as to be located outside the tub, the stator creating a rotation magnetic field, and a rotor configured to be rotated by the rotation magnetic field provided by the stator, the rotating shaft being fixed to the rotor.

The agitator may include a body provided inside the drum and fixed to the rotating shaft and taking a form of a circular plate that is parallel to the bottom surface of the drum, and an arm protruding from the body towards the tub introduction opening.

The laundry treatment apparatus may further include a communication hole formed in the bottom surface of the drum for communication of an inside of the drum with an inside of the tub, and an agitator through-hole formed in the body.

Advantageous Effects

The present invention may provide a laundry treatment apparatus capable of minimizing the volume thereof while increasing the enhancing washing ability thereof.

In addition, the present invention may provide a laundry treatment apparatus in which a drum, in which laundry is stored, and an agitator, which is rotatably provided inside the drum, are rotated by a single drive unit.

In addition, the present invention may provide a laundry treatment apparatus in which an agitator is rotated a predetermined number of times inside a drum, and thereafter, the agitator and the drum are rotated in opposite directions.

DESCRIPTION OF DRAWINGS

FIGS. 1 and 2 illustrate an exemplary laundry treatment apparatus according to the present invention.

FIGS. 3 and 4 illustrate an exemplary agitator, drum fixing unit, and power transmission unit according to the present invention.

FIGS. 5 and 6 illustrate the operating procedure of the power transmission unit according to the present invention.

BEST MODE

Reference will now be made in detail to the exemplary embodiments of the present invention, examples of which are illustrated in the accompanying drawings. Meanwhile, the configuration of an apparatus or a control method thereof, which will be given below, is merely intended to explain exemplary embodiments of the present invention, rather than limiting the technical scope of the present invention. Throughout the specification, the same reference numerals denote the same constituent elements.

As illustrated in FIG. 1, a laundry treatment apparatus 100 of the present invention includes a cabinet 1, a drawer 2 provided so as to be introduced into and removed from the cabinet 1, and a laundry accommodation unit 3 and 4 provided inside the drawer to provide a laundry treatment space.

The cabinet 1 may include an opening 11, and the drawer 2 may be removed from the cabinet 1 or may be inserted into the cabinet 1 through the opening 11. The cabinet 1 may have a longer length in the width direction (Y-axis direction) than in the height direction (Z-axis direction) (i.e., the drawer may have a longer length in the width direction than in the height direction).

As illustrated in FIG. 2, the drawer 2 includes a drawer body 21, having an open top side, and a drawer cover 25 provided in the open side of the drawer body. That is, the drawer body 21 may have an empty hexahedral shape, and the drawer cover 25 may be fixed to the drawer body 21 so as to form the top surface of the drawer body 21.

The drawer body 21 may be removed from the cabinet 1 or may be inserted into the cabinet 1 via a slider. The slider may include a slider body 271, which is fixed to one of the cabinet 1 and the drawer body 21, and a slider housing 273, which is fixed to the other one of the cabinet and the drawer body to provide the movement path of the slider body 271.

A drawer panel 23 is provided on the front surface of the drawer body 21. The drawer panel 23 serves to open and close the opening 11 in the cabinet.

The drawer panel 23 may be provided with a control panel 231 (see FIG. 1), which controls the operation of the laundry treatment apparatus 100. The control panel 231 includes a unit (a controller for the laundry treatment apparatus) for controlling, for example, means (a water supply unit and a drain unit) for supplying water to the laundry accommodation unit 3 and 4 or discharging the water therefrom, means (a drive unit) for providing rotational force to laundry, and means (a hot air supply unit and a moisture supply unit) for supplying steam or hot air to laundry.

In addition, the control panel 231 may include an input unit, which allows a user to input a control command to the laundry treatment apparatus 100, and a display unit (means for displaying information on the operation of the laundry treatment apparatus), which allows the user to check the control command input via the input unit, or notifies the user of the process of executing the control command input by the user.

The drawer cover 25 may include a first cover through-hole 251 and a second cover through-hole 253, which are formed in the drawer cover 25 for communication of the inside of the drawer body 21 with the outside.

The laundry accommodation unit 3 and 4 provided inside the drawer 2 may include a tub 3, which is provided inside the drawer body 21 to provide the space in which water is stored, and a drum 4, which is rotatably provided inside the tub to store laundry therein.

The tub 3 may include a tub body 31, which is fixed inside the drawer 2 via a tub support unit 311, and a tub cover 32, which defines the top surface of the tub body.

The tub cover 32 includes a tub introduction opening 33 for communication of the inner space of the tub body 31 with the outside of the tub. The tub introduction opening 33 is opened and closed by a door 35.

The door 35 is rotatably provided on the tub cover 32 (provided so as to open and close a portion of the tub cover). The door 35 may be rotated to the outside of the drawer 2 through the first cover through-hole 251 formed in the drawer cover 25. That is, the door 35 is provided so as to be located inside the space defined by projecting the first through-hole 251 onto the tub cover 32. Thus, the user may introduce laundry into the tub introduction opening 33 by opening the door 35 after removing the drawer 2 from the cabinet 1.

The tub cover 32 includes a water supply hole 37, through which water is introduced into the tub body 31. One end of a water supply pipe 511, which will be described later, is fixed to the water supply hole 37.

The drum 4 includes a cylindrical drum body 41 and communication holes 411 for communication of the inside of the drum body with the tub. The communication holes 411 may be provided in the circumferential surface of the drum body 41 and in the bottom surface 43 (drum bottom surface) of the drum body. Thus, the water stored in the tub body 31 may move to the inside of the drum body 41 through the communication holes 411, and the water inside the drum body 41 may move to the tub body 31 through the communication holes 411.

A drum introduction opening 42 is provided in the top surface of the drum body 41 so that the laundry supplied through the tub introduction opening 33 is introduced into the drum body 41.

The reason why the laundry accommodation unit 3 and 4 includes the tub 3 and the drum 4 is to enable the laundry treatment apparatus 100 of the present invention to perform a washing function. Thus, when it is necessary to enable the laundry treatment apparatus 100 to further perform a laundry drying function, a hot air supply unit (not illustrated) is further provided inside the cabinet 1 to supply hot air to the tub 3.

The hot air supply unit (not illustrated) provided in the laundry treatment apparatus 100 may include a circulation duct configured to circulate the air inside the tub 3 and a heat exchanger provided inside the circulation duct for dehumidification and heating of the air discharged from the first tub.

Alternatively, the hot air supply unit (not illustrated) provided in the laundry treatment apparatus may include a discharge duct, which discharges the air inside the tub to the outside of the cabinet 1, a supply duct, which supplies the air outside the tub to the tub 3, and a heat exchanger, which heat the air introduced into the supply duct.

In the case where the laundry treatment apparatus 100 of the present invention is provided to perform a laundry washing function, the laundry treatment apparatus 100 further requires a water supply unit and a drain unit.

The water supply unit may include the water supply pipe 511, which interconnects a water source located outside the cabinet 1 and the water supply hole 37, and a valve 513, which opens and closes the water supply pipe 511.

The water supply pipe 511 penetrates the drawer cover 25 through the second cover through-hole 253. The water supply pipe may have a flexible structure or may be formed of an elastic material in consideration of the movement range of the drawer.

The drain unit serves to discharge the water stored in the tub 3 to the outside of the cabinet 1. The drain unit may include a drain pipe 541, which guides the water inside the tub 3 to the outside of the cabinet 1, and a pump 543, which is provided on the drain pipe 541 to discharge the water inside the tub 3. The drain pipe may also have a flexible structure or may be formed of an elastic material.

In order to minimize the volume of the laundry treatment apparatus 100 having the above-described structure, it is necessary to minimize the volume of the laundry accommodation unit 3 and 4. However, when the volume of the laundry accommodation unit 3 and 4 is reduced, the amount of water that may be stored in the tub 3 is reduced, which may deteriorate washing performance.

In order to solve the problem described above, the laundry treatment apparatus 100 of the present invention may further include an agitator 6, which is rotatable inside the drum 4.

As illustrated in FIG. 3, the agitator 6 serves to agitate the laundry supplied to the drum body 41. The agitator may include a body 61 provided inside the drum and arms 63 protruding from the body 61 towards the drum introduction opening 42.

The body 61 may take the form of a circular plate parallel to the drum bottom surface 43, and the arms 63 may be radially disposed about the rotation center of the body 61.

The body 61 is rotated by a rotating shaft 67. As illustrated in FIG. 2, the rotating shaft 67 may penetrate the bottom surface of the tub and the drum bottom surface 43 so as to be fixed to the body 61, and may be at a right angle relative to the ground (at a right angle relative to the bottom surface of the cabinet).

In this case, a bearing 39 may further be provided on the bottom surface of the tub to rotatably support the circumferential surface of the rotating shaft 67, and the drum bottom surface 43 may include a drum penetration hole, into which the rotating shaft is inserted.

As illustrated in FIG. 3, the agitator 6 may further include agitator through-holes 611 formed in the body 61. When the body 61 of the agitator is a plate that is parallel to the drum bottom surface 43, the body 61 may prevent the movement of water to be discharged to the tub 3 through the drum bottom surface 43 or water to be introduced through the drum bottom surface 43 from the tub. The agitator through-holes 611 serve to solve the problem described above.

The drum 4 and the agitator 6, having the above-described structure, may be rotated in the same direction at the same time, or the agitator 6 may be rotated alone, by a drive unit 7, a drum fixing unit 8, and a power transmission unit 9.

Described in more detail, the drive unit 7, the drum fixing unit 8, and the power transmission unit 9 rotate the agitator 6 and the drum 4 in the same direction at the same time once the agitator 6 has been rotated a predetermined number of times (once the rotating shaft has been rotated a predetermined number of times).

As illustrated in FIG. 2, the drive unit 7 may include a stator 71, which is fixed to the tub and creates a rotating magnetic field, and a rotor 73, which is rotated by a rotating magnetic field provided by the stator.

The stator 71 is fixed to the bottom surface of the tub body 31 so as to be located outside the tub body 31, and the rotating shaft 67 is fixed to the rotor 73.

Unlike while is illustrated in FIG. 2, the drive unit 7 may include a driven pulley, which is fixed to the rotating shaft 67 so as to be located outside the tub 3, a motor, which is fixed outside the tub 3, a driving pulley, which is rotated by a rotating shaft of the motor, and a belt, which interconnects the driving pulley and the driven pulley.

However, when the drive unit 7 is provided in the form illustrated in FIG. 2, the present invention may minimize power loss (i.e. may improve washing ability), which occurs in the transmission process of power, compared to the case in which power is supplied from the motor through the driving pulley, the driven pulley, and the belt.

As illustrated in FIG. 3, the drum fixing unit 8 includes a fixing body 81, which is fixed to the drum bottom surface 43, a body through-hole 82 formed in the fixing body 81, and an accommodation body 83, which is fixed to the fixing body 81 to provide a space in which the power transmission unit 9 is accommodated.

The fixing body 81 serves to form the rotation center of the drum 4. The fixing body 81 may be further provided with a plurality of fixing arms 85, which are fixed to the drum bottom surface 43. In this case, the fixing arms 85 may be radially disposed about the body through-hole 82.

The accommodation body 83 is provided in a manner such that a cross section thereof that is parallel to the drum bottom surface 43 (a cross section that is parallel to a cross section of the body through-hole, which is parallel to the drum bottom surface) forms a concentric circle with the body through-hole 82. That is, the accommodation body 83 may take the form of a ring-shaped pipe, which surrounds the body through-hole 82.

In this case, the body 61 may further be provided with a hub 613, which surrounds the top surface and the circumferential surface of the accommodation body 83. In order to allow the accommodation body 83 to be rotated inside the hub 613, the hub 613 needs to have a shape that does not interfere with the accommodation body 83.

The power transmission unit 9 may reciprocate inside the body through-hole 85 when the rotating shaft 67 is rotated. The power transmission unit 9 has a feature in that it is provided to transmit power provided by the rotating shaft 67 to the fixing body 81 when the rotating shaft 67 is rotated a predetermined number of times.

The power transmission unit 9 may include a driving gear 91, which is fixed to the rotating shaft 67 so as to be located inside the accommodation body 83, a driven gear 95, which is provided along the inner circumferential surface of the accommodation body, and a connector 93, which interconnects the driving gear and the driven gear.

The connector 93 may include at least two connection gears 935, 937 and 939, which interconnect the driving gear 91 and the driven gear 95. FIG. 3 illustrates an exemplary case in which the connection gears include a first gear 935, a second gear 937, and a third gear 939.

The connection gears 935, 937 and 939 are rotatably fixed to a housing 931, which is rotatably provided inside the accommodation body 83. The housing 931 includes a housing through-hole 933, through which the rotating shaft 67 passes. In this case, the driving gear 91 is fixed to the circumferential surface of the rotating shaft 67, which is located inside the housing through-hole 933.

The housing 931 is provided with a first shaft 935*a*, which forms a rotating shaft of the first gear 935, a second shaft 937*a*, which forms a rotating shaft of the second gear 937, and a third shaft 939*a*, which forms a rotating shaft of the third gear 939.

As illustrated in FIG. 4, the respective shafts 935*a*, 397*a* and 939*a* are located in the space between the driving gear and the driven gear 95, among the space provided by the accommodation body 83, and the respective connection gears 935, 937 and 939 are rotatably fixed to the respective shafts 935*a*, 397*a* and 939*a* to interconnect the driving gear 91 and the driven gear 95.

Accordingly, when the fixing body 81 is not rotated due to the resistance of water stored in the tub body 31 or the weight of laundry stored in the drum 4, the housing 931 may be rotated inside the accommodation body 83 by the respective connection gears 935, 937 and 939 when the driving gear 91 is rotated.

The first gear 935, the second gear 937, and the third gear 939 may be spaced apart from each other by the same angle about the rotating shaft 67, and the drawing illustrates an exemplary case in which the respective gears are spaced apart from each other by 120 degrees.

At least one of the housing 931 or the fixing body 81 includes a housing stopper 97 (see FIG. 3), which stops the rotation of the housing 931 when the rotating shaft 67 is rotated a predetermined number of times.

The housing stopper 97 serves to stop the rotation of the housing 931 when the rotating shaft 67 completes one or more rotations. FIG. 4 illustrates an exemplary case in which the housing stopper 97 includes a first stopper 971 fixed inside the accommodation body 83 and a second stopper 973 provided on the housing 931 so as to come into contact with the first stopper when the housing 931 is rotated by a predetermined reference angle.

The gear ratio of the driving gear 91, the driven gear 95, and the connection gears 935, 937 and 939 may be set so as to stop the rotation of the housing 931 when the rotating shaft 67 completes one or more rotations (when the body 61 of the agitator completes one or more rotations). This serves to allow the body of the agitator to perform at least one time of rotation, thereby causing the formation of irregular water streams by the agitator 6 and agitation of the laundry stored inside the drum 4 in order to enhance washing ability.

FIG. 4 illustrates an exemplary case in which the reference angle is set to an angle that is equal to or greater than 270 degrees and is less than 360 degrees. In this case, the gear ratio of the driving gear 91, the driven gear 95, and the connection gears 935, 937 and 939 may be set to bring the first stopper 971 into contact with the second stopper 973 when the agitator 6 completes four or five rotations.

Hereinafter, an operating procedure of the above-described laundry treatment apparatus will be described with reference to FIGS. 5 and 6.

As illustrated in FIG. 5, when current is supplied to create a magnetic field that causes the stator 71 to be rotated in the clockwise direction, the rotor 73 and the rotating shaft 67 are rotated in the clockwise direction.

When the rotating shaft 67 is rotated in the clockwise direction, the agitator 6, which is fixed to a portion of the rotating shaft 67, which is located inside the drum, may be rotated in the clockwise direction inside the drum 4, and the driving gear 91, which is fixed to a portion of the circumferential surface of the rotating shaft 67, which is located inside the housing through-hole 933, may be rotated in the clockwise direction.

When the driving gear 91 is rotated in the clockwise direction, the connection gears 935, 937 and 939 may be rotated in the counterclockwise direction by the driven gear 95.

However, for the washing of laundry, when water is stored in the tub 3 and laundry is stored in the drum 4, the driven gear 95 may remain stationary and the housing 931 may be rotated in the clockwise direction.

This is because, since the drum 4 is rotated only when it overcomes the resistance of water and the weight of laundry, at the stage at which the rotating shaft 67 begins to rotate, the drum 4 and the driven gear 95, which is fixed to the drum via the fixing body 81, may not be rotated. Thus, in the present invention, the agitator 6 may be rotated during a certain time after the rotating shaft 67 begins to rotate, and the drum 4 may remain not rotated When the housing 91 is rotated via the rotation of the rotating shaft 67, the driving gear 91, and the connection gears 935, 937 and 939, the second stopper 973 fixed to the housing moves towards the first stopper 971.

As illustrated in FIG. 6, when the second stopper 973 comes into contact with the first stopper 971, the rotation of the housing 91 stops.

When the rotation of the housing 91 stops, since the driven gear 95 is rotated in the counterclockwise direction by the connection gears 935, 937 and 939, the drum 4, which is connected to the driven gear 95 via the accommodation body 83 and the fixing body 81, may also be rotated in the counterclockwise direction.

When the agitator 6 and the drum 4 are rotated in opposite directions, the laundry inside the drum may be moved inside the drum 4 by the agitator 6 and the friction thereof with water may be maximized by irregular water streams formed inside the tub 3, whereby the laundry treatment apparatus of the present invention may enhance washing ability.

On the other hand, when the supply of current to the stator 71 is blocked, the rotating shaft 67 stops rotation, and thus the agitator 6 is no longer rotated inside the drum 4. However, even though the rotation of the rotating shaft 67 stops, the drum 4 may remain rotated in the counterclockwise direction due to inertia.

When the drum 4 is rotated in the counterclockwise direction after the rotation of the rotating shaft 67 stops, the connection gears may be rotated in the counterclockwise direction along the circumferential surface of the driving gear 91 by the driven gear 95.

In this case, the housing 931 may be rotated in the counterclockwise direction until the second stopper 973 is coupled to the first stopper 971.

In order to increase the durability of the first stopper 971 and the second stopper 973, the first stopper 971 may further include an elastic body 991 and 993, which pushes the second stopper 973 far away from the first stopper 971 when the second stopper 973 is coupled to the first stopper 971.

That is, the elastic body may include at least one of a first spring 991 or a second spring 993. FIG. 6 illustrates an exemplary case in which the elastic body includes both the first spring 991 and the second spring 993.

When the housing 931 is rotated in the clockwise direction so that the second stopper 973 comes into contact with the first stopper 971, the first spring 991 may serve to push the second stopper 973 in the counterclockwise direction. When the housing 931 is rotated in the counterclockwise direction so that the second stopper 973 comes into contact with the first stopper 971, the second spring 993 may serve to push the second stopper 973 in the clockwise direction.

The structures or functions of the drive unit 7, the drum fixing unit 8, and the power transmission unit 9 described above are based on the case in which the tub is provided in the drawer, which may be introduced into or removed from the cabinet, but the drive unit, the drum fixing unit, and the power transmission unit may also be applied to the laundry treatment apparatus from which the drawer is omitted.

That is, the drive unit 7, the drum fixing unit 8, and the power transmission unit 9 may also be applied to the laundry treatment apparatus including the cabinet 1, the tub 3 fixed inside the cabinet, and the drum 4 rotatably provided inside the tub.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:

a tub configured to store water, the tub defining a tub introduction opening that allows introduction of laundry to the tub and removal of laundry from the tub;

a drum located inside of the tub and configured to receive laundry through the tub introduction opening;

an agitator located inside of the drum and configured to rotate relative to the drum;

a drum fixing unit comprising:

a fixing body coupled to the drum, the fixing body defining a body through-hole, and an accommodation body coupled to the fixing body, the accommodation body having a circular shape that is concentric with the body through-hole;

a rotating shaft that penetrates the tub and the drum, that is connected to the agitator through the tub and the drum, and that inserts into the body through-hole;

a driving gear located inside of the accommodation body and coupled to the rotating shaft;

a driven gear arranged along an inner circumferential surface of the accommodation body;

connection gears located between the driving gear and the driven gear and configured to connect the driving gear to the driven gear;

a housing located inside of the accommodation body and configured to, based on rotation of the connection gears, rotate relative to the accommodation body, the connection gears being rotatably coupled to the housing; and a housing stopper located at one or more of the housing or the fixing body, the housing stopper being configured to stop rotation of the housing based on the rotating shaft having rotated for a predetermined number of times relative to the drum, wherein the housing stopper comprises:

a first stopper located inside of the accommodation body, and a second stopper located at the housing and configured to contact the first stopper based on the housing having rotated by a reference angle from an initial position.

2. The apparatus according to claim 1, wherein the housing stopper is configured to stop rotation of the housing based on the rotating shaft completing multiple rotations relative to the drum.

3. The apparatus according to claim 1, wherein the driving gear, the driven gear, and the connection gears are configured to rotate based on a gear ratio that enables the first stopper to contact the second stopper in response to the rotating shaft completing one or more rotations relative to the drum.

4. The apparatus according to claim 3, wherein the reference angle is greater than or equal to 270 degrees and less than 360 degrees with respect to the initial position.

5. The apparatus according to claim 1, further comprising an elastic body located at the first stopper and configured to push the second stopper away from the first stopper based on the second stopper approaching toward the first stopper.

6. The apparatus according to claim 5, wherein the elastic body comprises at least one of (i) a first spring configured to push the second stopper in a counterclockwise direction based on rotation of the housing in a clockwise direction or (ii) a second spring configured to push the second stopper in the clockwise direction based on rotation of the housing in the counterclockwise direction.

7. The apparatus according to claim 1, wherein the connection gears are spaced apart from each other by an angle about the rotating shaft.

8. The apparatus according to claim 1, further comprising:

a cabinet that defines an opening; and a drawer that accommodates the tub and that is configured to insert into or withdraw from the cabinet through the opening.

9. The apparatus according to claim 8, wherein the rotating shaft penetrates a bottom surface of the tub and a bottom surface of the drum to couple to the agitator.

10. The apparatus according to claim 9, wherein the rotating shaft defines a right angle relative to a bottom surface of the cabinet.

11. The apparatus according to claim 9, wherein a drive unit comprises:

a stator coupled to the bottom surface of the tub and located outside of the tub, the stator being configured to generate a rotational magnetic field; and a rotor configured to rotate based on the rotational magnetic field generated by the stator, and wherein the rotating shaft is coupled to the rotor.

12. The apparatus according to claim 9, wherein the agitator comprises:

a body located inside of the drum and coupled to the rotating shaft, the body having a circular plate shape that is parallel to the bottom surface of the drum; and an arm that protrudes from the body towards the tub introduction opening.

13. The apparatus according to claim 12, further comprising:

a communication hole that is defined in the bottom surface of the drum and that allows communication between an inside of the drum and an inside of the tub; and an agitator through-hole that is defined in the body of the agitator.

14. The apparatus according to claim 7, wherein the connection gears are arranged about the rotating shaft by a same angle interval between the connection gears.

15. A laundry treatment apparatus comprising:

a tub configured to store water, the tub defining a tub introduction opening that allows introduction of laundry to the tub and removal of laundry from the tub;

a drum located inside of the tub and configured to receive laundry through the tub introduction opening;

an agitator located inside of the drum and configured to rotate relative to the drum;

a drum fixing unit comprising:

a fixing body coupled to the drum, the fixing body defining a body through-hole, and an accommodation body coupled to the fixing body, the accommodation body having a circular shape that is concentric with the body through-hole;

a rotating shaft that penetrates the tub and the drum, that is connected to the agitator through the tub and the drum, and that inserts into the body through-hole;

a driving gear located inside of the accommodation body and coupled to the rotating shaft;

a driven gear arranged along an inner circumferential surface of the accommodation body;

connection gears located between the driving gear and the driven gear and configured to connect the driving gear to the driven gear;

a housing located inside of the accommodation body and configured to, based on rotation of the connection gears, rotate relative to the accommodation body, the connection gears being rotatably coupled to the housing; and a housing stopper located at one or more of the housing or the fixing body, the housing stopper being configured to stop rotation of the housing based on the rotating shaft having rotated for a predetermined number of times relative to the drum, wherein the housing has a cylindrical shape, and wherein the connection gears comprise:

first portions that protrude radially outward from an outer surface of the housing, and second portions that protrude radially inward from an inner surface of the housing.

16. The apparatus according to claim 1, wherein each of the connection gears comprises a shaft that is located in the housing and that extends in an axial direction parallel to the rotating shaft.

17. The apparatus according to claim 6, wherein the elastic body comprises both of the first spring and the second spring that are located opposite sides of the first stopper.

18. The apparatus according to claim 1, wherein a diameter of the driving gear is less than diameters of the connection gears.

19. The apparatus according to claim 1, wherein the driving gear is spaced apart from the driven gear in a radial direction of the rotating shaft.

20. The apparatus according to claim 1, wherein the housing has a cylindrical shape, and wherein the connection gears comprise:

first portions that protrude radially outward from an outer surface of the housing, and second portions that protrude radially inward from an inner surface of the housing.

* * * * *